United States Patent [19]

Fetherston et al.

[11] 4,040,137

[45] Aug. 9, 1977

[54] BINDING FOR WATER SKI

[75] Inventors: William H. Fetherston, Bellevue; Maurice N. Theriault, Renton, both of Wash.

[73] Assignee: Composite Structures Corporation, Kent, Wash.

[21] Appl. No.: 714,992

[22] Filed: Aug. 16, 1976

Related U.S. Application Data

[63] Continuation of Ser. No. 578,732, May 19, 1975, abandoned.

[51] Int. Cl.[2] ..... A63C 15/06

[52] U.S. Cl. ..... 9/310 AA

[58] Field of Search ..... 9/310 AA; 280/11.35 R, 280/11.35 A, 11.35 H; 151/33, 54

[56] References Cited

U.S. PATENT DOCUMENTS

| | | | |
|---|---|---|---|
| 88,668 | 4/1869 | Philippi | 151/54 |
| 667,339 | 2/1901 | Ruffhead | 151/54 |
| 686,504 | 11/1901 | Beach et al. | 151/54 |
| 2,327,783 | 8/1943 | Hains | 9/310 AA |
| 2,740,972 | 4/1956 | Taylor | 9/310 AA |
| 2,933,741 | 4/1960 | Walter | 9/310 AA |
| 3,097,376 | 7/1963 | Forsman | 9/310 AA |

*Primary Examiner*—Trygve M. Blix
*Assistant Examiner*—Stuart M. Goldstein
*Attorney, Agent, or Firm*—Morris A. Case

[57] ABSTRACT

A water ski binding having a heel piece binding with a flexible heel boot held in place with an adjustable heel member. The heel member is U-shaped and has an elongated slot in each leg. The upper part of the slot extends outward to form a shoulder and an insert having a pair of slots fills the elongated slot to permit custom fit of the heel piece.

The shoulder formed in the elongated slot varies in width to form a series of recesses each of which will accept an extension of a fastener to positively lock the fastener in place when the heel binder is used as an adjustable member. A front piece binding with a flexible foot restraining boot is rigidly held in place with a shaped member. The shaped member is fastened around the periphery with a series of recessed holes shaped to accept a nut recessed below the outer surface of the rigid member.

8 Claims, 9 Drawing Figures

BINDING FOR WATER SKI

This is a continuation, of application Ser. No. 578,732, filed May 19, 1975 and now abandoned.

BACKGROUND OF THE INVENTION

The heel piece of a water ski may be made adjustable so that it can be readily adapted to fit the foot size of different users. In U.S. Pat. No. 3,049,734 a Y-shaped hold down member for the rubber heel boot had three elongated slots; two of which were located on the legs and the third located on the stem. Pins are located to extend up through the slots to permit the Y-shaped member to move longitudinally along the ski. The pin extending throuh the slot on the stem has a housing to contain a spring to force a tongue down into one of a series of perforations located on the stem and parallel to the slot to lock the hold down member in position. U.S. Pat. No. 3,088,138 has an adjustable Y-shaped hold down member with three similar parallel slots that locks in selected position due to a fastened block that locks in one of a series of serrations extending along one side of the slot located in the stem. It is also known to custom fit the heel piece of a water ski, and to permanently fasten the heel piece to the ski. It was discovered that a simplified adjustable hold down piece may be adapted to be used either as an adjustable or as a custom fit heel piece.

SUMMARY OF THE INVENTION

An adjustable heel piece for a water ski contains a hold down member for a rubber boot that actually contacts the heel of a person's foot when in use. The hold down member is U-shaped and has an elongate longitudinally extending slot in each of the legs of the U. The slots are parallel to each other and are of a uniform width throughout the length of the slot in at least a portion of the breadth of the slot. A shoulder is formed around the sides of the slot and is formed by a recess extending down from the top or outer face of the hold down member. The shoulder varies in width to present a side against which a hold down fastener may act to insure against member movement when fastened down. The shoulder when seen in plan view is preferably shaped like a series of adjoining outwardly extending arcs of a circle with axes centered in the elongated slot and the arcs arranged symmetrically around the elongated slot. When used for custom fitting a removable insert is shaped to snugly fill each of the elongated slots with the enlarged part of the insert bottoming on the shoulder. The insert has a hole located adjoining or near to each end of the slot for accepting a fastener when the insert is installed in the elongated slot of the hold down member. A horseshoe shaped hold down member for rigidly holding down a resilient rubber like boot for the fore part of the foot is rigidly fastened to the water ski with screws that are arranged at intervals around the horseshoe shaped member. Alternatively the binding is rigidly held with a fastener having a bolt and nut. When the water ski binding is fastened to a plate which in turn is fastened to a ski the hold down members are fastened with a machine screw or bolt that extends up from the plate and joins the hold down member with a nut which is recessed down from the top of the hold down member. The recess is shaped to match the nut to lock the nut in place when secured to the machine screw.

It is an object of this invention to provide an adjustable heel piece for a water ski to provide positive locking of the heel piece within a pair of slots also used for slideably aligning the heel piece.

It is another object of this invention to provide inserts into aligning slots of an adjustable heel piece for a water ski to provide custom fitting of the heel piece.

It is another object of this invention to provide a series of spaced apart recesses in a ski binding hold down member with the recess shaped to accept a nut.

DETAILED DESCRIPTION

Figure 1:
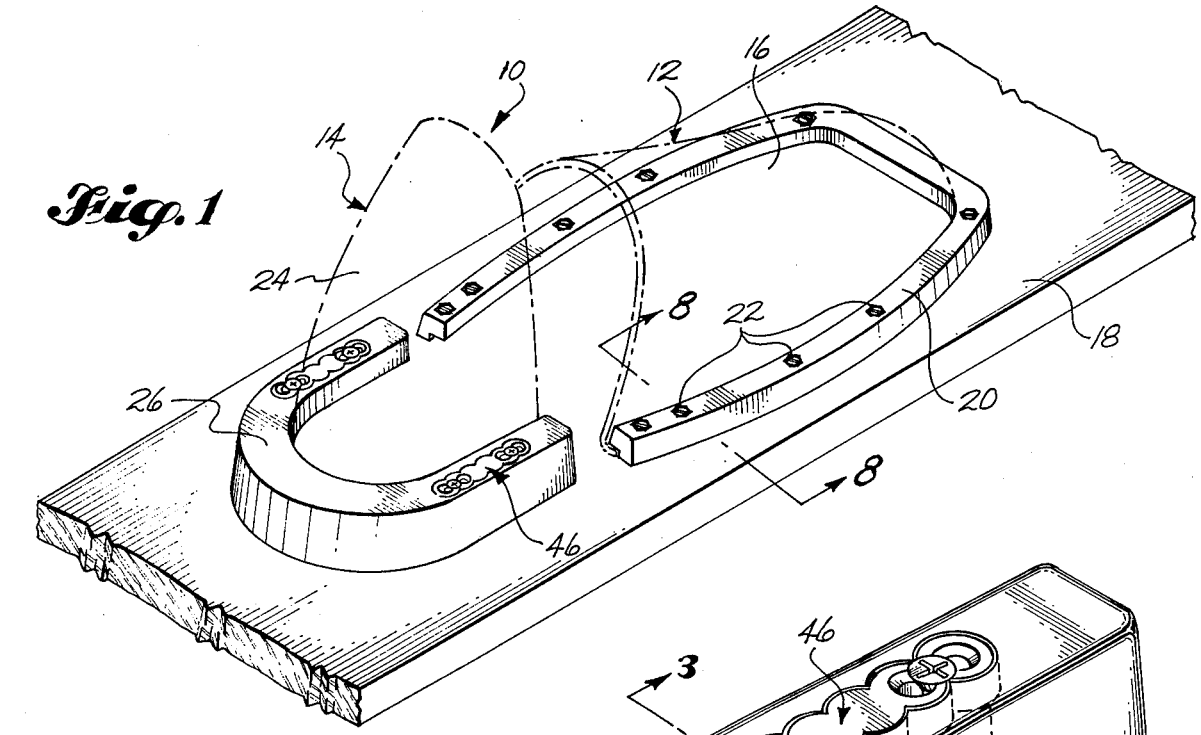
FIG. 1 is a perspective view of this invention showing a foot support mounted to a section of a water ski with the heel piece mounted with use of an insert.
Figure 2:
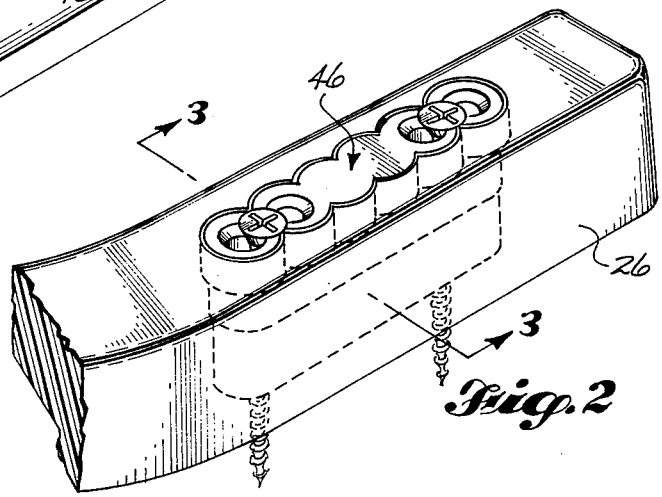
FIG. 2 is an enlarged perspective view showing the heel down part of FIG. 1.
Figure 4:
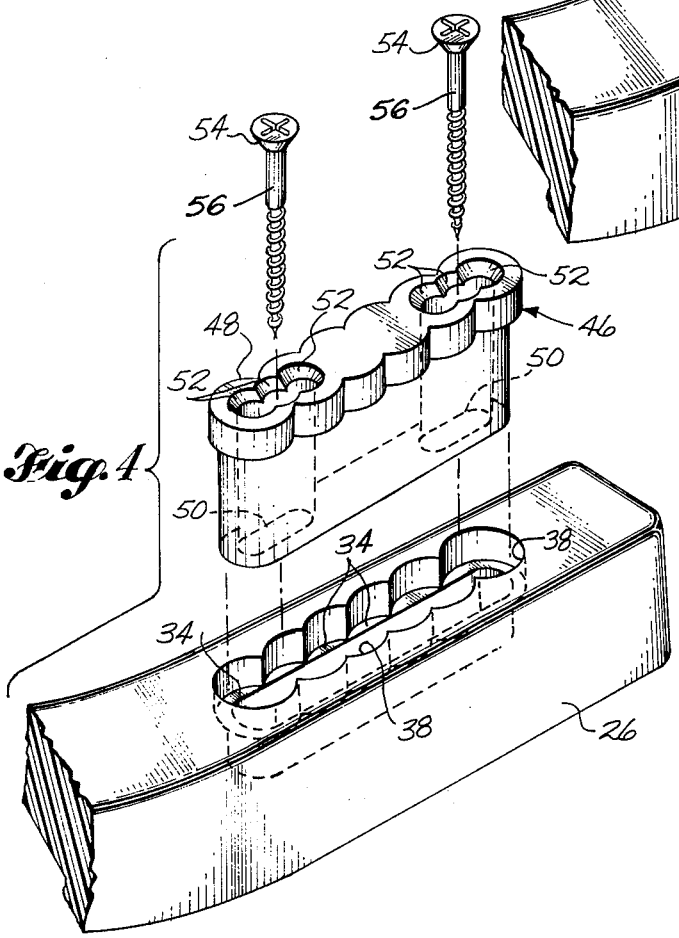
FIG. 4 shows an exploded perspective view of FIG. 2.
Figure 3:
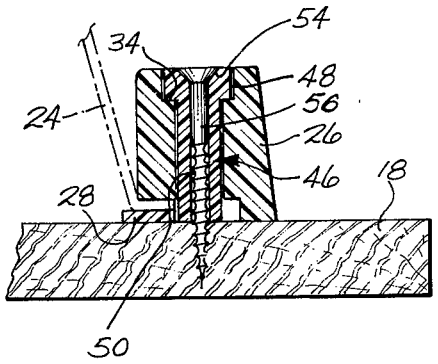
FIG. 3 is a sectional view along line 3—3 of FIG. 2 of the hold down with insert.

A foot binding unit 10, with the front part of the foot binder 12 and the heel binder 14, as shown in FIG. 1. A resilient material 16, shaped to accept the front part of a person's foot is rigidly fastened to a water ski 18, by use of a horseshoe hold down member 20, with a set of fasteners 22. The adjustable heel unit 14 for binding the heel of a person's foot has a resilient rubber like heel boot 24, which is held in place with a U-shaped hold down or support member 26, which preferably is made from a resin such as polycarbonate or reinforced nylon. The resilient boot may be held down between the water ski and the support member, but preferably is held between the support member and a U-shaped retainer 28. Units common throughout the various figures will be given the same identifying numbers.

Figure 5:
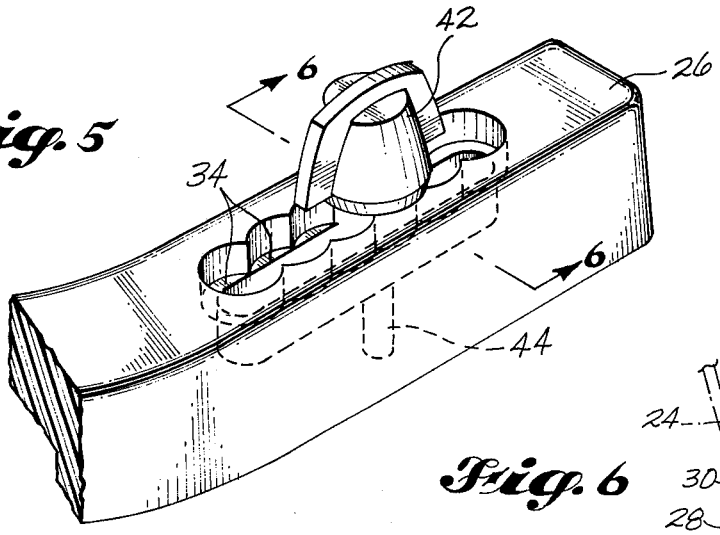
FIG. 5 shows a perspective view as in FIG. 2, but with the insert removed from the heel piece and using the adjustable configuration of the heel piece.
Figure 6:
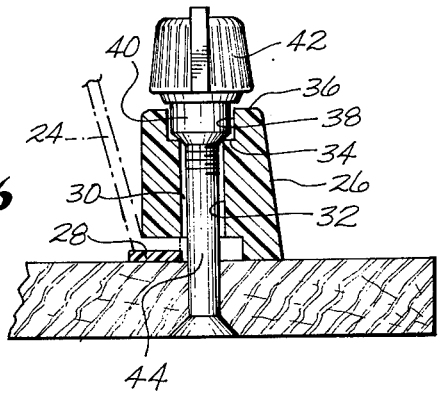
FIG. 6 is a sectional view taken along line 6—6 of FIG. 5.
Figure 7:
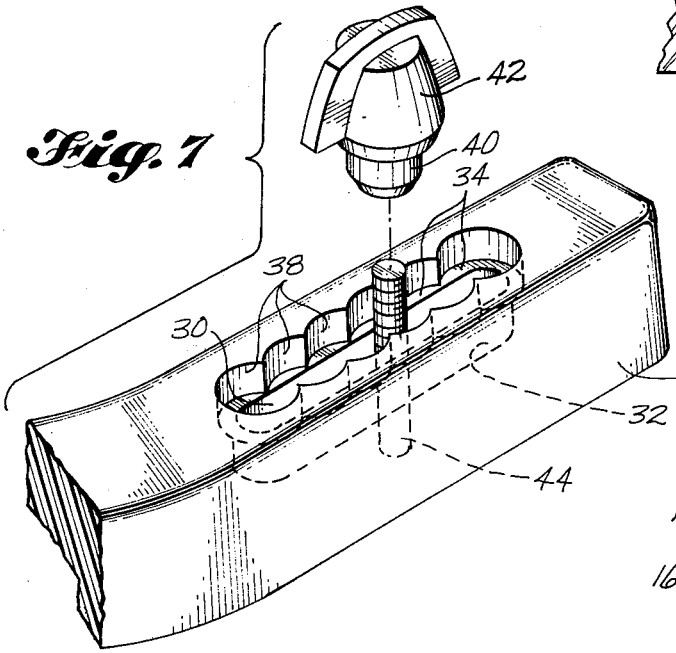
FIG. 7 is an exploded perspective view of FIG. 5.
Figure 10:
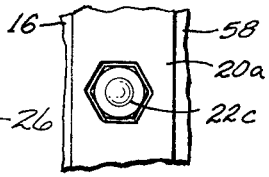
FIG. 10 is a fragmented plan view taken along lines 10—10 of FIG. 9.

In FIGS. 5 through 7 the hold down member 26, is shown as a member for use in an adjustable heel unit. An elongated slot 30, with a uniform width defined by sides 32, has a shoulder 34, formed by a recess extending part way down from the top surface 36, of the U-shaped hold down member. The shoulder is preferably shaped as a series of adjoining circular recesses extending down into the hold down member with axes of the circles centered in the elongate slot, and with the diameter of the circles greater than the width of the slot across sides 32. The outer arc 38, of the circles provide the sides to act in conjunction with a circular shaped extension of a part 40, coextensive with wing nut 42, to positively lock the U-shaped hold down member when the nut is fastened to threaded fastener 44, as shown in FIGS. 5 and 6. The fastener joins to the water ski 18, extends through the elongated slot, and then is secured by the nut. The fastener is not limited to this means as it may, for example, also be fastened with a nut having an extension thence a threaded rod for threading into the water ski. Part 40 is an integral part of the nut as shown. However, it may be a sleeve which will permit the use of varied shapes to match the contour of the shoulder 34. The elongated slots in the U-shaped member permit the member to have longitudinal adjustment when mounted to the water ski 18.

The same hold down member 26, is used in FIGS. 1 through 4 to permit rigid custom mounting to fit the foot of a person wanting a fixed setting of the heel binding 14. An insert 46, preferably molded of a material such as polycarbonate or reinforced nylon is shaped to completely and snugly fill slot 30, with the enlarged part 48, of the insert bottoming out on shoulder 34. The insert has a pair of holes which in this embodiment are shown as slots 50. These holes are located contiguous to the ends of the inserts of the elongated slots, and preferably have axes centered in the elongated slot. A series of adjoining countersink holes 52, are located at the top of the insert to provide sides to act in conjunction with tapered sides 54, of threaded fastener screws 56. The slots 50, in the insert 46, permit limited adjustment when custom fitting the heel binding.

This heel binding permits selecting an adjustable or a custom heel binding. To convert an already installed adjustable heel binding to a custom heel binding, the threaded fastener 44, is removed, insert 46, is placed in elongated slot 30, the heel positioned then rigidly fastened to the water ski with screws 56. Alternately the custom heel binding may be fastened with bolts and nuts.

Figure 9:
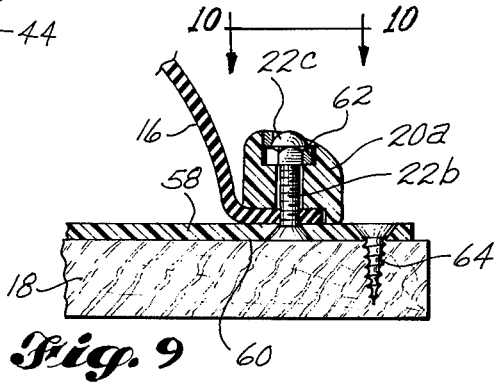
FIG. 9 is a different embodiment of the sectional view of FIG. 8 when a hold down member is fastened to a plate before fastening to a water ski.
Figure 8:
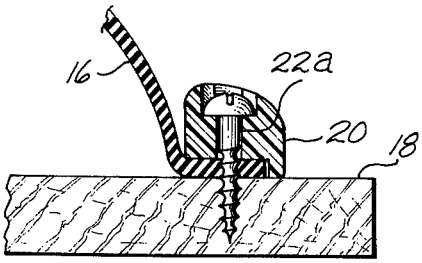
FIG. 8 is a sectional view taken along line 8—8 of FIG. 1.

The horseshoe shaped fore foot hold down member 20 is rigidly fastened to the ski. Preferably, as is shown in FIG. 8, the fastener 22*a* is a screw. The horseshoe shaped member also may be held down with a combination machine screw and nut. In certain applications ski bindings are not fastened directly to the water ski. Instead, the bindings are directly fastened to a plate 58, as shown in FIG. 9. When fastening to a plate it is preferable to use a machine screw 22*b* to extend up from the bottom 60 of the plate and to fasten the hold down member 20*a* with a nut 22*c*. The boot 16 is held between the hold down member and the plate. In this configuration the nut extends into recess 62 which is shaped to match the nut. This may be square or hexagonal to match the nut. Thus, when the screw is tightened the nut works into and locks in the shaped recess. This prevents loosening of the fastener, and effects considerable savings in installation. The plate to which the bindings are fastened is then mounted to water ski 18, preferably with screws 64.

I claim:

1. A water ski binding for a heel of a person's foot, said binding having an essentially U-shaped hold down member for a resilient heel boot and having longitudinally extending elongate slots on each leg of the U-shaped member for mounting with longitudinal adjustment to the ski, the new combination comprising: means for filling each of the longitudinally extending elongated slots on each leg of the U-shaped hold down member comprising an insert having means for mounting the hold down member to the water ski through holes in the inserts.

2. A water ski binder for a heel of a person's foot, said binding having an essentially U-shaped hold down member for a resilient heel boot and having longitudinally extending elongate slots on each leg of the U-shaped member for mounting with longitudinal adjustment to the ski, the new combination comprising: said U-shaped member having a series of adjoining circular recesses extending part way in from a top of the member with axes of the circular recesses centered in the elongate slot and a diameter of the circles greater than a width of the slot, and a removable insert shaped to fill the elongate slot, said insert having a hole extending therethrough contiguous to each end of the elongate slot and on an axis centered in the elongate slot.

3. A water ski binder for a heel of a person's foot as in claim 1 wherein the holes in the insert extend inward to form a slot, and a series of adjoining countersink holes extend along the top of the slots in the insert.

4. A heel unit for a water ski to adapt an adjustable heel unit to a custom fit heel unit wherein a U-shaped support member has a resilient boot fastened thereto, said support member having an elongated slot extending longitudinally along each leg of the U-shaped member, a fastener extending through the elongated slot to the water ski to permit longitudinal adjustment of the heel unit, the new combination comprising: a shoulder extending around a periphery of the elongated slot, an insert dimensioned to snugly fill a space in the elongated slot from the top to the bottom of the support member, and the insert having a hole adjacent each end.

5. A heel unit for a water ski as in claim 4 wherein the hole through the insert extends longitudinally to form a pair of slots, and the insert has a series of contiguous countersink holes centered in the insert slots.

6. A heel unit for interchangeable use as an adjustable heel unit with conversion to a fixed heel unit for custom fit and maximum support wherein a U-shaped support member has a resilient heel boot fastened thereto, said support member having an elongated slot extending longitudinally along each leg of the U-shaped member and a fastener extending through the slot to a water ski to allow longitudinal adjustment of the heel unit with respect to the water ski, the new combination comprising: a series of adjoining outwardly extending arcs of a circle, with axis centered in the elongated slot, arranged symmetrically around the elongated slot to extend part way downward to form a recess around the slot; a removable insert dimensioned to snugly fill the elongated slot, said insert having a hole with axis centered in the elongated slot, said hole contiguous to each end of the elongated slot.

7. A heel unit for a water ski as in claim 6 wherein the holes in the insert extend inward to form a longitudinally extending slot, and a series of adjoining countersink holes are centered in the insert slot.

8. A method of converting an adjustable heel unit for a water ski wherein the heel unit is adjustable with a pair of elongated slots for allowing longitudinal adjustment of the heel unit with the fasteners extending through the slots to the water ski with the steps comprising: removing the fasteners, forming a shoulder by recessing around the elongated slot, filling the elongated slot with an insert having a pair of holes for accepting a pair of fasteners, and fastening the adjustable heel unit to the water ski through the holes in the insert.

* * * * *